United States Patent [19]

Yokoyama et al.

[11] Patent Number: 5,049,845

[45] Date of Patent: Sep. 17, 1991

[54] WELDING FREE RELAY CONTACT DEVICE

[75] Inventors: Yoichi Yokoyama; Hiroaki Hamaguchi; Hideya Kondo; Nobuhiro Kitamura; Takatoshi Hongyou, all of Kadoma, Japan

[73] Assignee: Matsushita Electric Works, Ltd., Osaka, Japan

[21] Appl. No.: 537,632

[22] Filed: Jun. 14, 1990

[30] Foreign Application Priority Data

Jul. 12, 1989 [JP] Japan ..... 1-318670

[51] Int. Cl.[5] ..... H01H 50/26; H01H 1/16

[52] U.S. Cl. ..... 335/133; 200/240; 335/128

[58] Field of Search ..... 200/240, 241, DIG. 42; 335/196, 195, 200, 133, 128, 135

[56] References Cited

U.S. PATENT DOCUMENTS

| | | | |
|---|---|---|---|
| 4,272,746 | 6/1981 | Wright et al. | 335/133 |
| 4,634,819 | 1/1987 | Ikeda | 200/16 |
| 4,650,935 | 3/1987 | Ootsuka et al. | 200/16 |
| 4,937,544 | 6/1990 | Mueller | 335/133 |

*Primary Examiner*—Harold Broome

[57] ABSTRACT

A contact device is provided with an additional mass member secured to a movable contactor carrying a movable contact capable of opening and closing contacts with a stationary contact, for providing to the movable contactor a mass acting in a direction perpendicular to longitudinal axis of the contactor. A rolling motion is thereby caused to occur in the movable contactor upon contact closing motion so that the movable contact can be prevented from being fusion-bonded to the stationary contact.

11 Claims, 10 Drawing Sheets

WELDING FREE RELAY CONTACT DEVICE

BACKGROUND OF THE INVENTION

This invention relates generally to contact devices and, more particularly, to a contact device in which a movable contact is provided to a resilient contactor made integral with a movable contact side terminal plate, for contact opening and closing operation with respect to a stationary contact provided to a stationary contact side terminal plate.

The contact device of the kind referred to can be utilized effectively in such electromagnetic relays as remote control type relays.

DESCRIPTION OF RELATED ART

In attempting to control loads employing power factor improvement capacitors by means of electromagnetic relays or the like, an extremely large rush current is generated upon making the relay. The rush current may happen to reach several hundred amperes or, in some occasion, even 1,000A, thus causing the undesired result of contact welding to take place between the stationary and movable contacts due to the rush current.

In the contact device of the kind referred to, therefore, it is desirable for the closing operation of the movable contact with respect to the stationary contact is quickly and stably executed. It is also desired that the fusion bonding between the stationary and movable contacts due to the rush current be restrained to render the device sufficiently durable. While the contact welding may be prevented to some extent by, for example, dimensionally enlarging the contact device in the entirety and eventually the electromagnetic relay or the like employing the contact device, this measure does not fit the general tendency of dimensional minimization intended for electric parts. In Japanese Utility Model Publication No. 56-5208 of H. Yamane, a microswitch has been suggested a which includes in which a permanent magnet is provided to a stationary side terminal plate having a stationary contact. A movable side terminal plate carrying a movable contact is provided with a magnetic plate, so that a quick and stable closing operation of the stationary and movable contacts can be assured through magnetic attraction between the permanent magnet and magnetic plate.

In this microswitch of H. Yamane, however, the suggested arrangement contributes to the quick and stable contact closing operation but no technical suggestion is disclosed for dealing with the large rush current that occurs upon the contact closing and the problems in of (1) contact welding between the contacts and (2) durability have been left unsolved.

SUMMARY OF THE INVENTION

A primary object of the present invention is, therefore, to provide a contact device which prevents the welding of the contacts due to the rush current and is capable of assuring a quick and stable contact closing operation.

According to the present invention, this object can be attained by means of a contact device in which a stationary contact is provided to a stationary contact side terminal plate, and a movable contact is provided to an end of a resilient movable contactor made integral at one end with a movable contact side terminal plate for contact closing and opening operation of the movable contact with the stationary contact, characterized in that an additional mass means is formed in a separate member and secured to the movable contactor for providing a mass acting in a direction perpendicular to longitudinal axis of the movable contactor.

Other objects and advantages of the present invention shall be made clear in following description of the invention detailed with reference to certain preferred embodiments shown in accompanying drawings.

Figure 31:
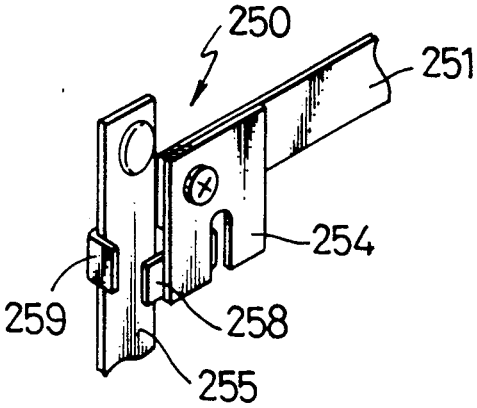
FIG. 31 is a fragmentary perspective view as magnified of the contact device in still another embodiment according to the present invention.
Figure 33:
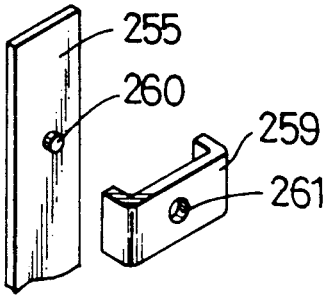
Figure 34:
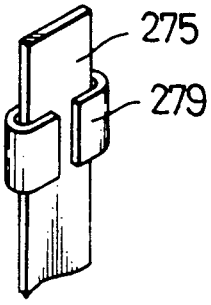

FIG., 32 is an explanatory plan view for the operation of the contact device of FIG. 31;

FIG. 33 is a further fragmentary perspectiye view of the device of FIG. 31 as seen from a different angle therefrom; and FIG. 34 is a fragmentary perspective view of the contact device in a still further embodiment according to the present invention.

While the present invention shall now be described with reference to the embodiments shown in the accompanying drawings, it should be appreciated that the intention is not to limit the invention only to these embodiments shown but rather to include all alterations, modifications and equivalent arrangements possible within the scope of appended claims.

DETAILED DESCRIPTION OF THE PREFERRED EMBODIMENTS

Referring to FIGS. 1 to 6 showing a contact device 10 in an embodiment according to the present invention, the contact device 10 comprises a resilient movable contactor 11 made integral with a movable contact side terminal plate (not shown here in FIGS. 1–6) by means of a welding or the like. The resilient movable contactor 11 is plate-shaped and provided at a tip end portion with a movable contact 12 secured to one surface of the plate-shaped contactor 11 and having a contacting surface slightly curved to be swelling, and with a suspended part 13 formed integrally with the contactor 11 into L-shape as extended in perpendicular direction with respect to longitudinal direction of the contactor 11. To a lower or extended end portion of the suspended part 13, an additional mass member 14 is secured on a side opposite to that of the movable contact 12, while the movable contact 12 is disposed to be engageable and disengageable with a stationary contact 16 secured to a stationary contact side terminal plate 15 for the contact closing and opening.

Figure 1:
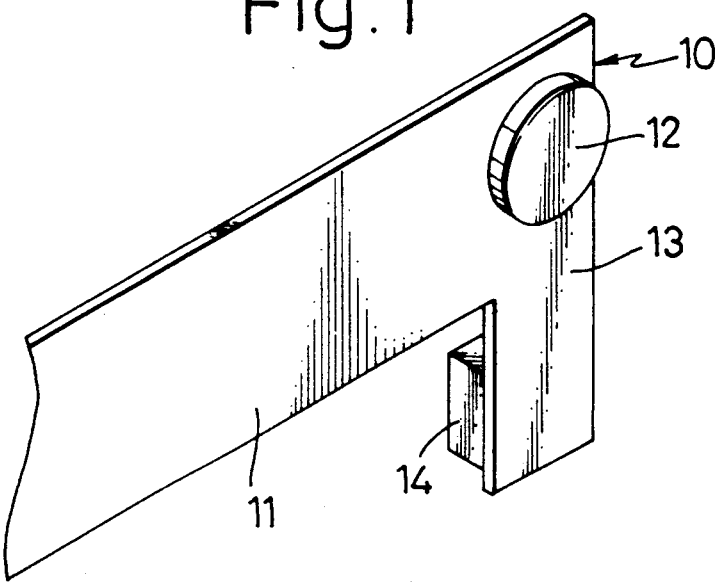
FIG. 1 a fragmentary perspective view as magnified of the resilient movable contactor made integral with a movable contact side terminal plate in an embodiment of the contact device according to the present invention.
Figure 2:
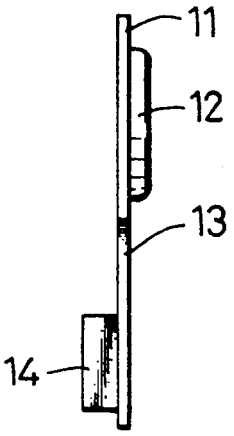
FIG. 2 is an endwise elevation of the contactor in FIG. 1.
Figure 3:
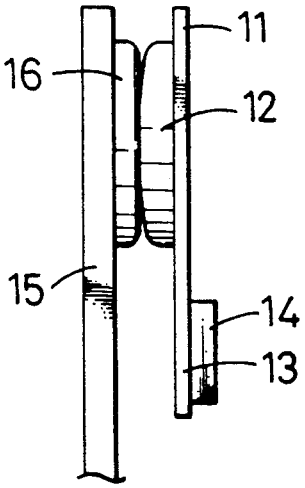
FIG. 3 is an endwise elevation of the movable contactor in its contact closing state with a stationary contact in the contact device according to the present invention.
Figure 4:
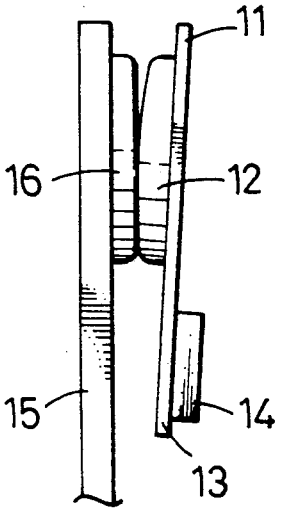
FIGS. 4 to 6 are explanatory views for operations achieved by the movable contact of FIG. 1 in the contact device according to the present invention.
Figure 5:
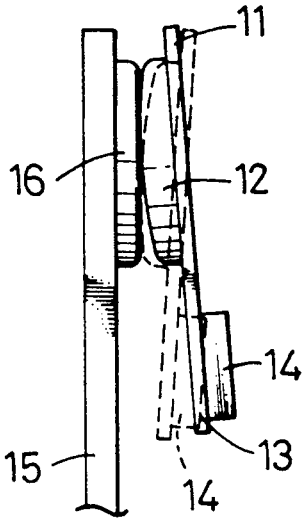
Figure 6:
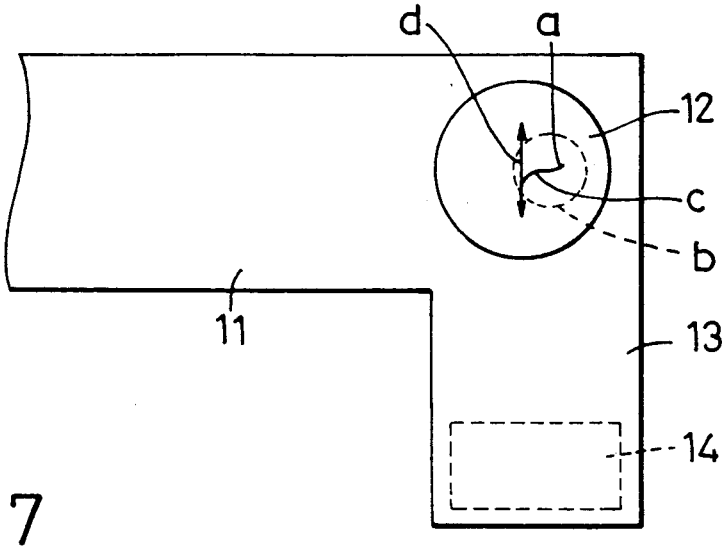

In the above arrangement, a resilient force of the movable contactor 11 integral with the movable contact side terminal plate acts as a contact pressure generating mechanism upon contact closing between the movable contact 12 and the stationary contact 16, whereby the movable contact 12 is eventually brought into intimate and tight contact with the stationary contact 16 (see in particular FIG. 3). In this case, at initial stage of contacting motion of the movable contact 12 with respect to the stationary contact 16, the movable contactor 11 is caused to be twisted to roll at the tip end portion first to a position shown in FIG. 4 and then from the position of FIG. 4 to a position shown by solid lines in FIG. 5 due to the mass of the additional mass member 14, and this rolling is repeated as a vibratory motion between the position of FIG. 4 as given by broken lines in FIG. 5 and the solid line position of FIG. 5. This vibratory motion is gradually attenuated to be stabilized in the state of FIG. 3. More specifically, this closing operation of the movable contact 12 with respect to the stationary contact 16 is carried out with such shifting locus of contacting point as represented by a curve in FIG. 6, the shifting occurring from an initial contacting point a through the locus to a point within a contact welding area shown by a dotted-line circle b, due to the additional mass given to the resilient movable contactor 11, and the stabilized state of the movable contact 12 is reached through the rolling vibration taking place the direction shown by a line arrow d. Therefore, even when contact welding is likely to occur between the movable and stationary contacts 12 and 16 due to the rush current applied across both contacts, the movable contactor 11 rolls with respect to the stationary contact side terminal plate 15 so as to remove the contacting point of the movable contact 12 with respect to the stationary contact 16 away from a welding area to be effective to reliably prevent contact welding from occurring between the both contacts 12 and 16.

Figure 7:
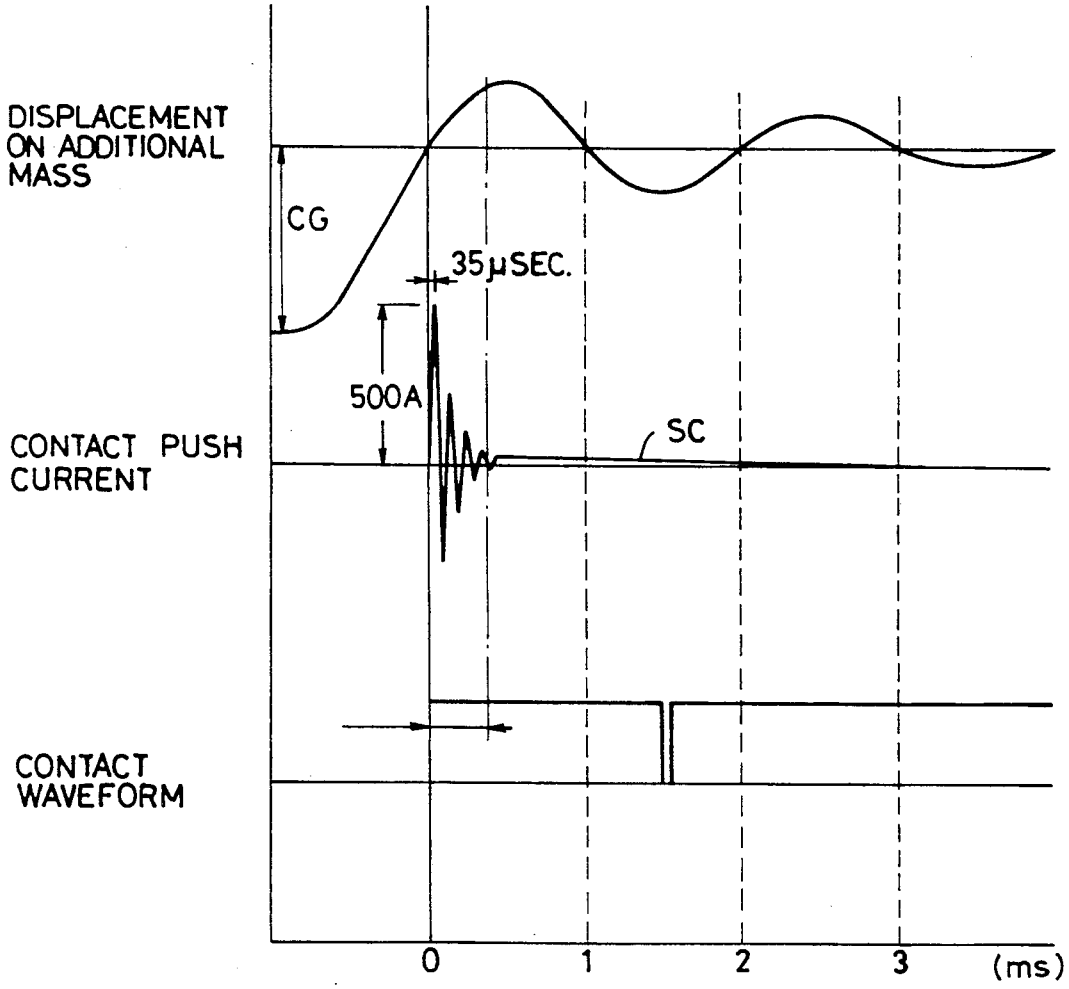
FIG. 7 is a diagram showing correlation between the rush current and additional mass in the relationship to time in the contact device including the movable contactor of FIG. 1.
Figure 9:
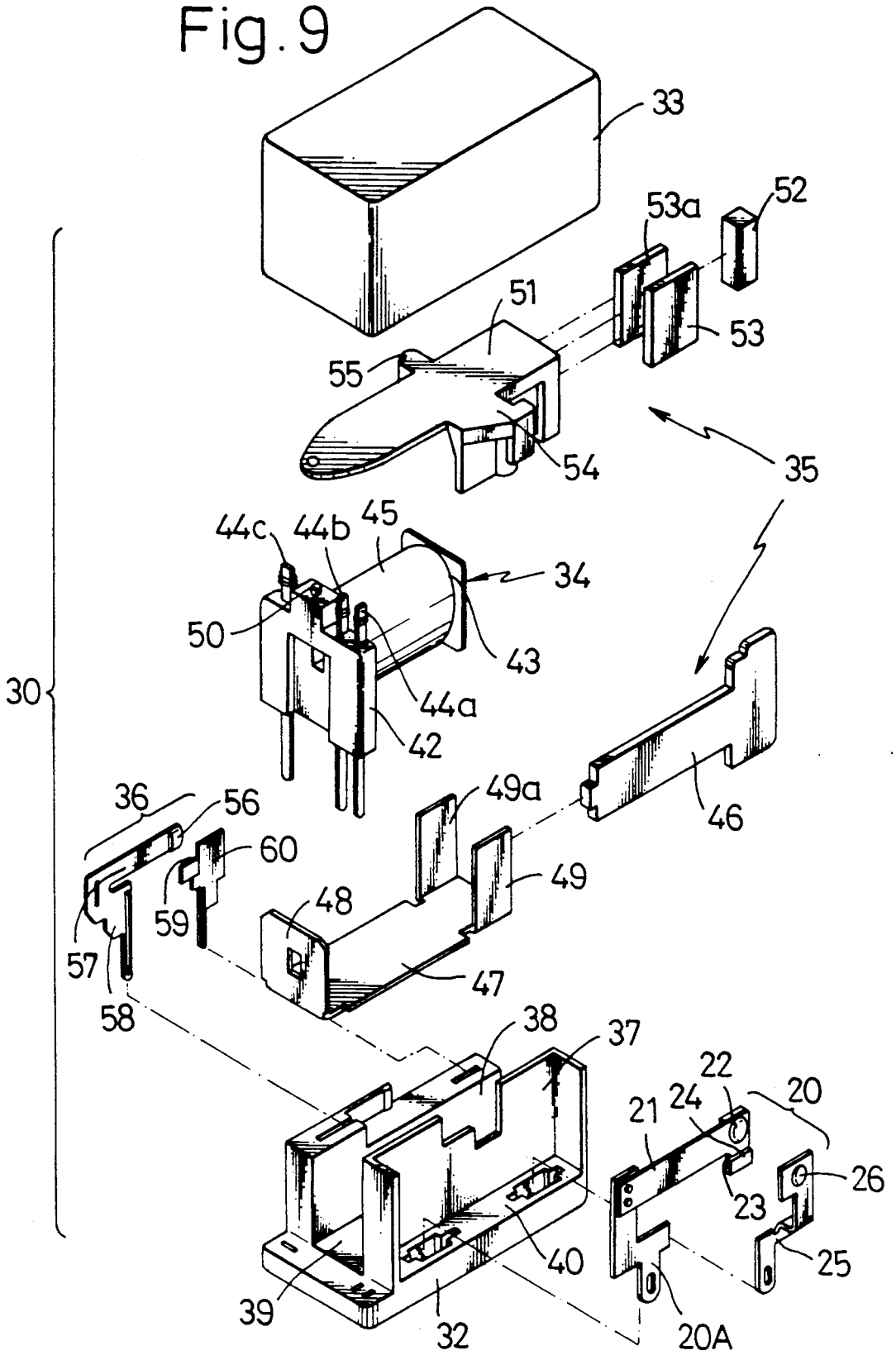
FIG. 9 is a perspective view as disassembled of the relay of FIG. 8, including the cover.

With the foregoing contact device 10 employed, experimental data on the displacement of the additional mass member 14 due to the rolling vibration and on the rush current waveform in relation to the contact opening and closing have been obtained, results of which were as shown in FIG. 7. In carrying out the experiment, the contact device having the movable contact 12 of a diameter 3 mm and a thickness of 0.4 mm and the additional mass member 14 of a mass about 0.1 gr. As will be clear from FIG. 7, the rush current of about 500A is caused to flow for about 35 μsec. after the contact making and, thereafter, the current is gradually attenuated so that a stable current SC will flow. In this example, as will be readily appreciated, the movable contact 12 comes to contact with the stationary contact 16 with a contact gap CG narrowered. Thereafter, the contact 12 rollingly vibrates due to the action of the additional mass so that a fusion b takes place at, for example, the initial contacting point a of FIG. 6 which can be prevented from resulting in the bonding between the both contacts, by the shifting of the contacting point, and thus a high resistance to contact welding between the both contacts can be provided to the contact device.

Further, in an event where the rush current lasts for a relatively longer time (while in the experiment of FIG. 7 the rush current occurrence is relatively short), the additional mass member 14 restricts the maximum amplitude of the movable contactor 11. When, for example, the rush current is to peak value upon the maximum amplitude of the additional mass member 14, the additional mass is effective to add a force in a direction of increasing the contact pressure between the both contacts 12 and 16 and thus a higher contact pressure can be attained. Consequently, the degree of contact between both contacts 12 and 16 is increased to be tighter. To reduce the contact resistance, inherent Joule heat is thereby decreased, and the fusion itself at the contacting point can be made to occur less frequently. As the additional mass member 14 starts displacing in the reverse direction a peeling force is applied between both contacts at the moment where the welding heat at the contact point starts being cooled, and the resistance to contact welding can be further improved.

Referring next to FIGS. 8 to 11, there is shown a remote controlled relay in which the contact device according to the present invention is employed, and this remote controlled relay 30 comprises a casing 31 which consisting of a base 32 and a cover 33 fitting to the base 32, the base and cover being made of such insulating material as plastics. Within the casing 31, an electromagnet means 34 and a contact operating means 35 actuated by the electromagnet means are disposed, while a main contact device 20 operated through the contact operating means, and an auxiliary contact device 36 is also provided concurrently.

On the base 32, there are provided as erected a pair of mutually separated partitions 37 and 38 which define, in association with the cover 33, a center chamber 39 and side chambers 40 and 41, the center chamber 39 accommodating therein the electromagnet means 34 of a DC operation type and the contact operating means 35. The electromagnet means 34 comprises a coil bobbin 42 having a bobbin body 43 on which coils 45 are wound for flowing therethrough electric currents alternately in reverse direction through coil terminals 44*a*, 44*b* and 44*c*. Through the bobbin body 43 of the coil bobbin 42, a stationary core 46 is passed, while a base end of the core 46 is supported by a supporting angle 48 at an end of a yoke 47, the angle 48 extending upward along an outer face of the coil bobbin 42, and the yoke 47 is also provided at the other end a pair of magnetic pole parts 49 and 49*a* extending upward from the yoke to be U-shaped as seen in longitudinal direction of the yoke 47. The coil terminals 44*a*–44*c* are planted in the base portion of the coil bobbin 42 to extend downward and further through the base 32 of the housing to be exposed thereout for a proper length.

The contact operating means 35 further includes a card 51 pivotably supported at a base end with a pivoting projection 50 of the coil bobbin 42, and a pair of armature plates 53 and 53*a* holding between them a permanent magnet 52 are secured to the other end of the card 51, so that these armatures 53 and 53*a* will be disposed to oppose both sides at the other end of the core 46. The card 51 is further provided at both side edges with a main pressing projection 53 and an auxiliary pressing projection 55, which extend in both sideward directions in which the card 51 is swingable with the projection 50 made as a fulcrum.

The main contact device 20 is provided substantially in the same arrangement as in the embodiment described to FIGS. 1–7. That is, a resilient movable with reference contactor 21 is pin-coupled or welded at an end to a movable contact side terminal plate 20A, a movable contact 22 is secured to the other end of the contactor 21, and a suspended part 23 is provided also at the other end of the contactor 21 to extend to be L-shaped in a direction perpendicular to the longitudinal direction of the contactor 21. To lower the end of the suspended part 23 and on its side opposite to the side having the movable contact 22, an additional mass member 24 is secured. A stationary contact side terminal plate 25 has a stationary contact 26 secured to an end of the plate 25, and the movable contact side and stationary contact side terminal plates 20A and 25 are passed through holes made to penetrate through the base 32 in the side chamber 40 to be led downward out of the base 32, while disposing the movable contact 22 of the movable contactor 21 to be engageable and disengageable with the stationary contact 26 of the stationary side terminal plate 25. The auxiliary contact device 36 comprises an auxiliary movable side terminal plate 58 made integral with a resilient movable contactor 57 carrying a movable contact 56, and an auxiliary stationary side terminal plate 60 carrying a stationary contact 59, and these auxiliary terminal plates 58 and 60 are also passed through holes made to penetrate through the base 32 at the other side chamber 41 to be led downward out of the base 32, while disposing the movable contact 56 engageable and disengageable with the stationary contact 59. In such disposition, the movable contactor 21 of the main contact device 20 is coupled to the main pressing projection 54 of the card 51 while the movable contactor 57 of the auxiliary contact device 36 is coupled to the auxiliary pressing projection 55 of the card 51 so that, when the card 51 swings to the side of the main contact device 20, both of the main and auxiliary contact devices 20 and 36 are closed and, when the card 51 swings reversely to the side of the auxiliary contact device 36, the both main and auxiliary contact devices 20 and 36 are opened.

Figure 10:
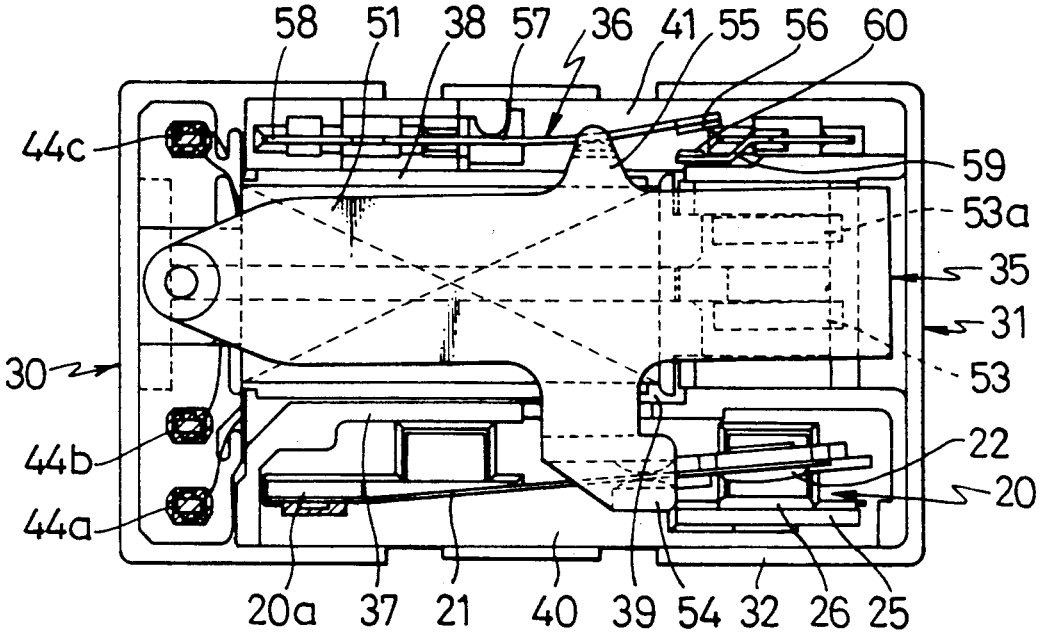
FIGS. 10 and 11 are explanatory plan views of the relay of FIG. 8 for its operation.
Figure 11:
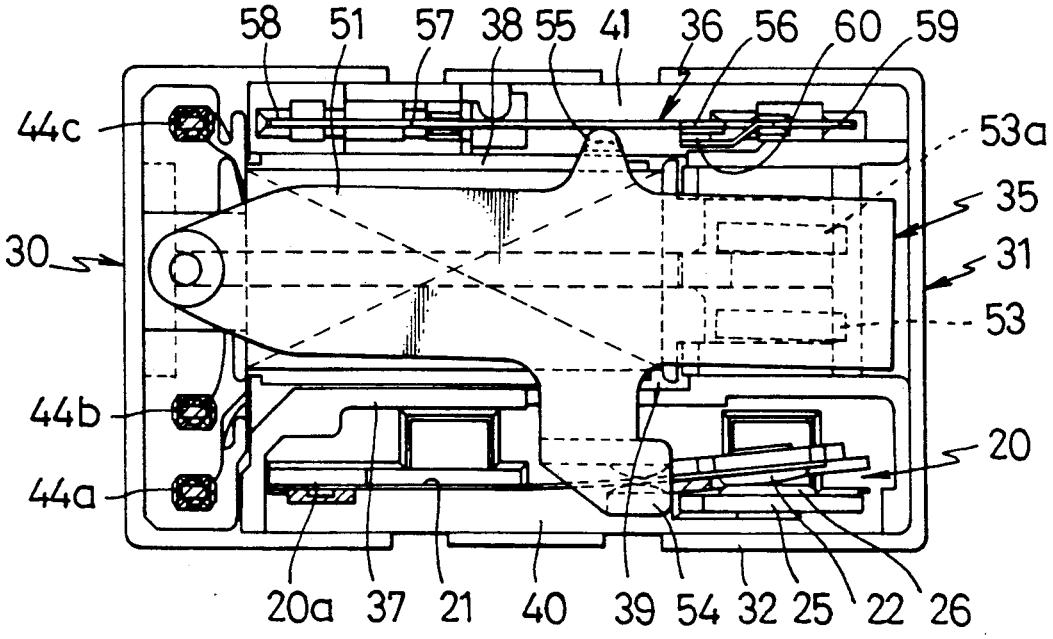

In the remote controlled relay of FIGS. 8–11, a current fed to the coil 45 of the electromagnet means 34 to flow therethrough in one direction causes the armatures 53 and 53*a* integral with the card 51 to be attracted by the attraction core 46 and the magnetic pole part 49*a* of the yoke 47 on the side of the auxiliary contact device 36, and the main and auxiliary contact devices 20 and 36 are both opened (see in particular FIG. 10). With a current fed to the coil 45 to flow therethrough in reverse direction, the armatures 53 and 53*a* of the card 51 are attracted by the attraction core 46 and the other magnetic pole part 49 on the side of the main contact device 20, and the main and auxiliary contact devices 20 and 36 are closed under the contact pressure provided by the resilient contactors 21 and 57 (see in particular FIG. 11). In this case, it is likely that the rush current is caused to flow in particular when the contact device 20 is closed, but the provision of the additional mass member 24 is effective, in the same manner as in the foregoing embodiment of FIGS. 1–7, to cause the resilient movable contactor 21 to roll and the contact points between the movable and stationary contacts 22 and 26 to be shifted positively. Thus, the movable and stationary contacts 22 and 26 can be effectively prevented from being contact welded.

Figure 12:
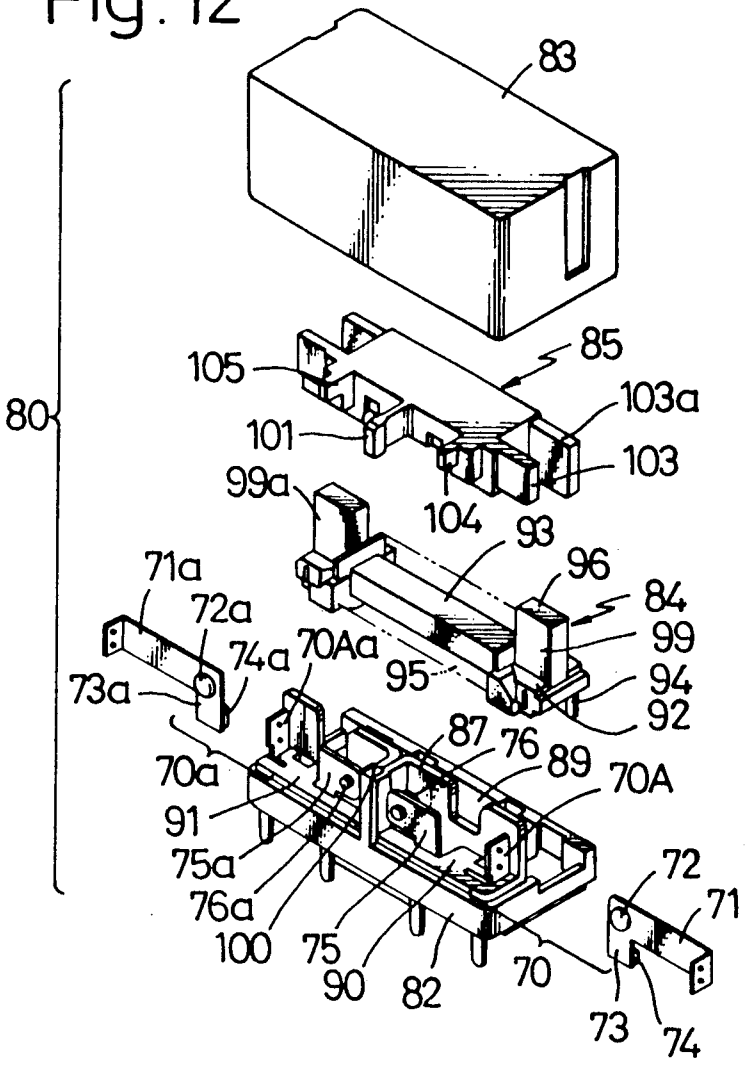
FIG. 12 shows in a perspective view as disassembled an electromagnetic relay employing the contact device of FIG. 1.
Figure 8:
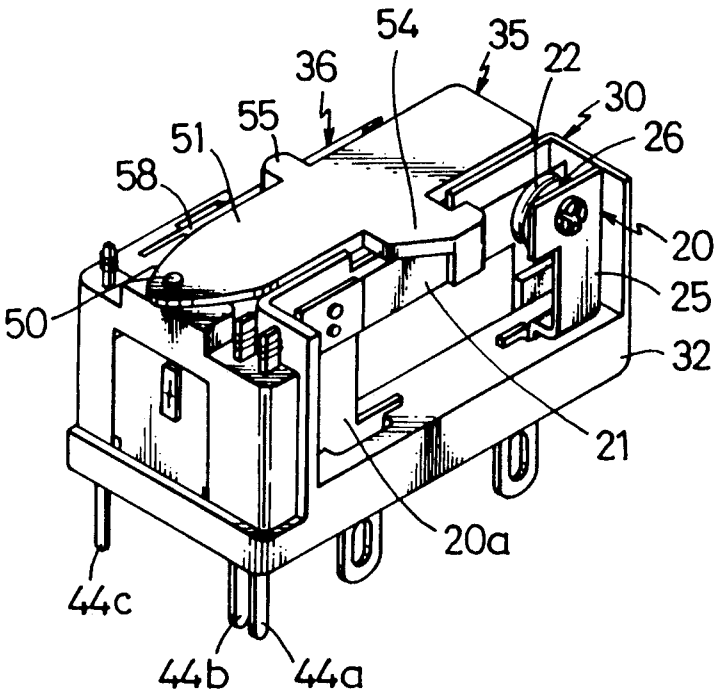
FIG. 8 is a perspective view of a remote controlled relay employing the contact device of FIG. 1 as shown with a cover removed for showing the interior.
Figure 13:
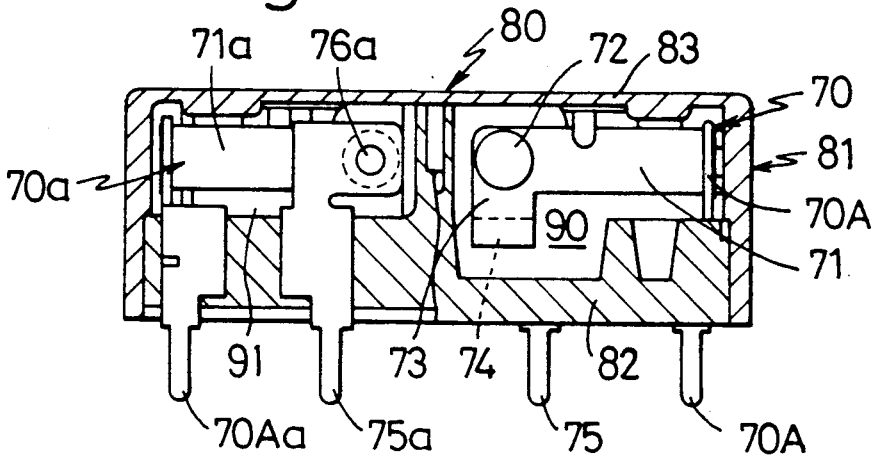
FIG. 13 is a longitudinally sectioned view of the relay of FIG. 12.
Figure 14:
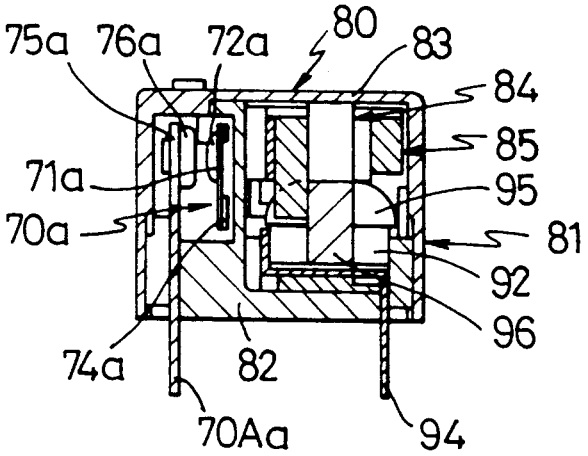
FIG. 14 is a cross-sectional view of the relay of FIG. 12 taken along a line perpendicular to the section of FIG. 13.

Referring next to FIGS. 12 to 14 showing an electromagnetic relay employing the contact device according to the present invention, this electromagnetic relay 80 comprises a casing 81 which consists of a base 82 and a cover 83 fitted over the base. Within this casing 81, an electromagnet means 84 and a contact operating means 85 actuated by the means 84 are provided, and a pair of contact devices 70 and 70*a* are further placed therein to be operated by the means 85 for contact opening and closing.

The base 82 is provided with a partition 87 erected therein so as to define, in association with the cover 83, a longitudinal chamber 89 on one side and two divided chambers 90 and 91 on the other side of the partition. In the longitudinal chamber 89, the electromagnet means 84 which is DC-operated type and the contact operating means 85 are accommodated and, in each of the two divided chambers 90 and 91, the contact devices 70 and 70a are respectively disposed. The electromagnet means 84 comprises a coil bobbin 92 having a bobbin body 93 on which a coil 95 is wound for passing therethrough a direct current alternately in reverse directions through coil terminals 94 (only one being shown here). An attraction core 96 is passed axially through the coil bobbin 92, and magnetic pole parts 99 and 99a are provided to be erected on both ends of the core 96 extended out of the bobbin 92 so that the core 96 will be U-shaped in longitudinal side elevation, while the coil terminals 94 are led downward out of the bobbin 92 and through the base 82.

The contact operating means 85 is provided at both ends of its elongated body with a pair of armatures 103 25 and 103a extended in longitudinal direction in parallel to each other and to be mutually of different length, and with a permanent magnet (not shown here) held between the armatures 103 and 103a preferably as made into a block by means of a plastic material as well known to ones skilled in the art. The armatures 103 and 103a form magnetic poles and their length difference is made alternate between opening pairs at the both ends of the elongated body. Further, on one longitudinal side of the contact operating means 85, there are provided a central projection 101 to be pivotably supported by a central pivot part 100 of the partition 87 of the base 82, and two card projections 104 and 105 on both sides with respect to the central projection 101 so as to extend through notches made in the partition 87 into the divided chambers 90 and 91 for alternately operating the contact devices 70 and 70a when the means 85 is placed on the electromagnet means 84 with the magnetic pole parts 99 and 99a disposed respectively between each pair of the armatures 103 and 103a and is rotated electromagnetically.

The contact devices 70 and 70a are respectively provided substantially in the same structure as in the foregoing embodiment of FIGS. 1-7. That is, resilient movable contactors 71 and 71a are coupled at one end, by means of pins, welding or the like, to movable contact side terminal plates 70A and 70Aa planted to the base 82 to be led downward thereout while movable contacts 72 and 72a are secured to the other free ends, and suspended parts 73 and 73a are extended to be L-shaped from the free ends in the direction perpendicular to longitudinal direction of the movable contactors while additional mass members 74 and 74a are secured to lower end portions of these suspended parts 73 and 73a on opposite side to that carrying the movable contacts 72 and 72a. Stationary contact side terminal plates 75 and 75a carrying stationary contacts 76 and 76a are also planted to the base 82 to be led downward thereout, so that the movable contacts 72 and 72a will be disposed for the contact opening and closing with the stationary contacts 76 and 76a. In this arrangement, the electromagnetic rotation of the contact operating means 85 in one direction with the 10, pivot part 100 as the fulcrum causes one of the contact devices 70 and 70a opened while the rotation in the other direction causes the other contact device 70 or 70a opened.

In the electromagnet relay of FIGS. 12-14, a current fed to flow in one direction through the coil 95 in the electromagnet means 84 causes longer extended ones of the armatures 103 and 103a at both ends of the contact operating means 85 to be attracted by the magnetic pole parts 99 and 99a of the attraction core 96 so that the contact operating means 85 is rotated in a clockwise direction. In response, the movable contractor 71, in one contact device 70, is urged by one card projection 104 to resiliently bend to have the movable contact 72 of the contactor 71 engaged to the stationary contact 76 of the stationary contact side terminal plate 75, for closing the contacts. While in this case contact welding of the contacts is likely to occur due to the rush current flowing upon the closing of the contact device 70, the same rolling motion of the movable contactor 71 as in the embodiment of FIGS. 1-7 is caused to take place by the action of the additional mass member 74, so that the contacting point between the movable and stationary contacts 72 and 76 can be positively shifted and the movable and stationary contacts 72 and 76 can be effectively prevented from being contact welded.

When a reverse directional current is fed to flow through the coil 95 of the electromagnet means 84, the shorter extended portions of the armatures 103 and 103a at the both ends of the contact operating means 85 are attracted by the magnetic pole parts 99 and 99a of the attraction core 96, so that an operation opposite to the above is carried out for closing the contacts in the contact device 70a. It will be appreciated here that the contact device 70a may be used exclusively for feeding and cutting signal currents similar to the auxiliary contact device in the foregoing relay of FIGS. 8-11.

Figure 15:
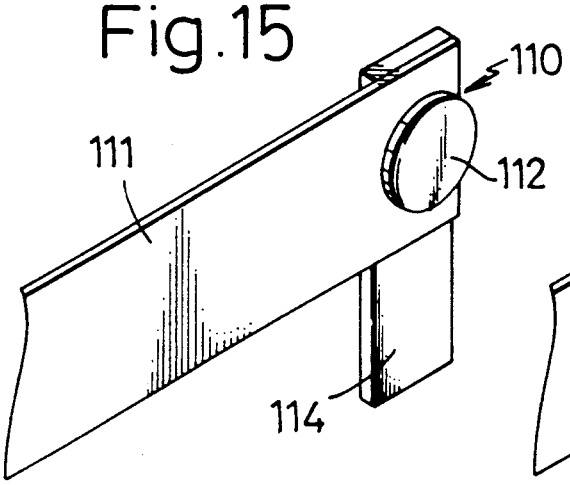
FIG. 15 shows in a fragmentary perspective view as magnified a resilient movable contactor in another embodiment for the contact device according to the present invention.
Figure 16:
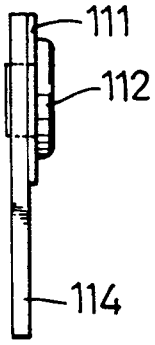
FIG. 16 is an endwise elevation of the movable contactor of FIG. 15.

Depicted in FIGS. 15 and 16 is another embodiment of the contact device according to the present invention. The contact device 110 includes a resilient movable contactor 111 which carries at its free end a movable contact 112. A relatively longer extended plate forming an additional mass member 114 is secured at one end portion to an opposite surface from that which carries the movable contact 112. At the same time, the movable contact 112 can be secured caulking so as to be such that it is right angles with respect to the longitudinal direction of the contactor 111. Other components and their functions in this embodiment are the same as those in the foregoing embodiment of FIGS. 1-7, and there can be attained a high resistance to the fusion bonding.

Figure 17:
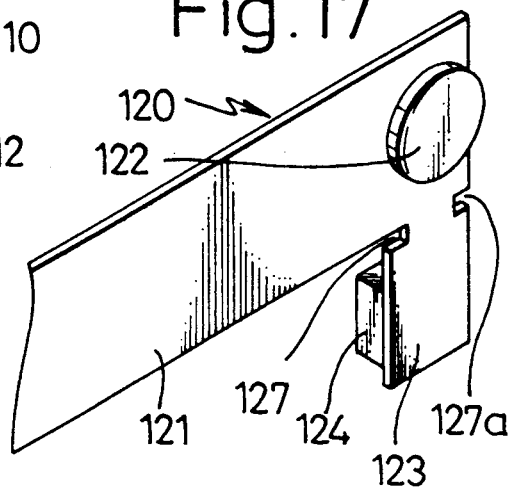
FIG. 17 shows in a fragmentary perspective view as magnified a resilient movable contactor in a further embodiment according to the present invention.
Figure 18:
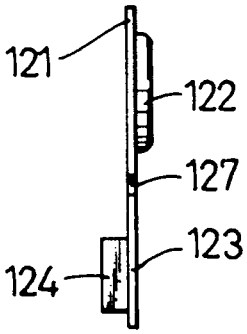
FIG. 18 is an endwise elevation of the movable contactor of FIG. 17.

In a contact device 120 in still another embodiment of the present invention shown in FIGS. 17 and 18, a resilient movable contactor 121 having a suspended part 123 substantially the same as that in the embodiment of FIGS. 1-7 is made to have notches 127 and 127a made in opposing edge portions at a connection of the suspended part 123 to the contactor 121, whereby the suspended part 123 carrying an additional mass member 124 is made to be swingable with a larger resiliency so as to increase the rolling motion occurring at the movable contact 122. Other components and their functions are the same as those in the embodiment of FIGS. 1-7, and there can be attained also a high resistance to the fusion bonding.

Figure 19:
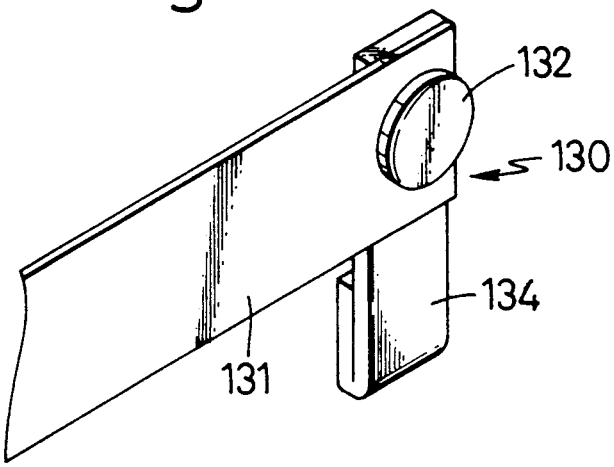
FIG. 19 shows in a fragmentary perspective view as magnified a resilient movable contactor in still another embodiment according to the present invention.
Figure 20:
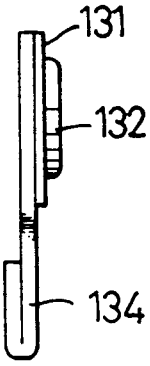
FIG. 20 is an endwise elevation of the movable contactor of FIG. 19.

In another contact device 130 in another embodiment shown in FIGS. 19 and 20, a resilient movable contactor 131 carrying at a free end a movable contact 132 has a relatively longer extended plate forming an additional mass member 134 secured at its one end portion to opposite surface at the free end of the contactor 131 to that carrying the contact 132 at the same time when the latter is secured so as to be at right angles with respect to the longitudinal axis of the contactor 131, and the other lower end portion of this additional mass member 134 is folded back to lie closely on the member 134 to increase the mass thereof. Other components and their functions in the present instance are the same as those in the embodiment of FIGS. 1–7 and the high resistance to the fusion bonding can be sufficiently provided to the contacts.

Figure 21:
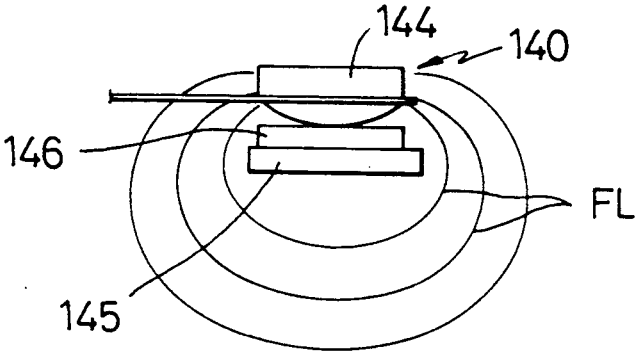
FIG. 21 is an explanatory view for a still further embodiment of the contact device according to the present invention.

According to another feature of the present invention, the additional mass member is formed with a magnetic material, and the contacting degree between the movable and stationary contacts is thereby increased to further improve the resistance to their contact welding. That is, referring to FIG. 21, a contact device 140 embodying the particular feature has a similar structure to that in the embodiment of FIGS. 1–7, and an additional mass member 144 provided here is formed by a magnetic material. Therefore, a magnetic flux FL generated by an electric current flowing through a stationary contact side terminal plate 145 carrying a stationary contact 146 is enlarged by the additional mass member 144 of the magnetic material, so that the additional mass member 144 will be attracted to the side of the stationary side terminal plate 145. Consequently, any electromagnetic repulsion between the movable and stationary contacts 142 and 146 can be prevented from occurring.

Figure 23:
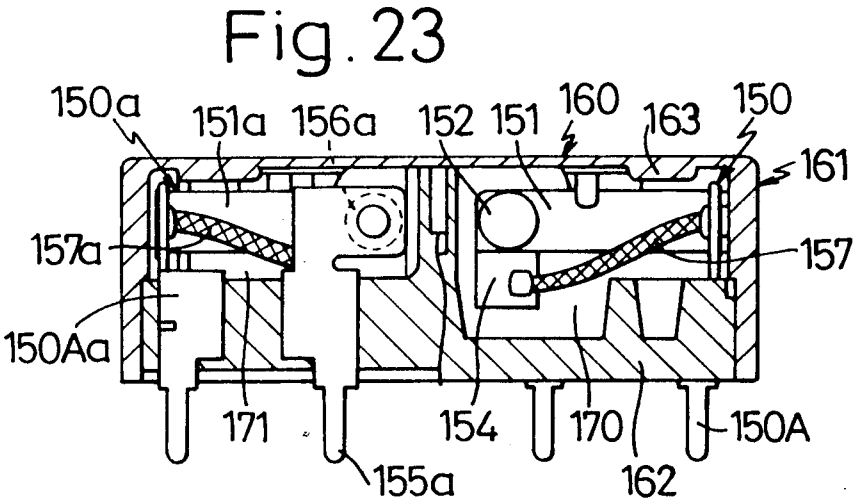
FIG. 23 is a longitudinally sectioned view of the relay of FIG. 22.
Figure 24:
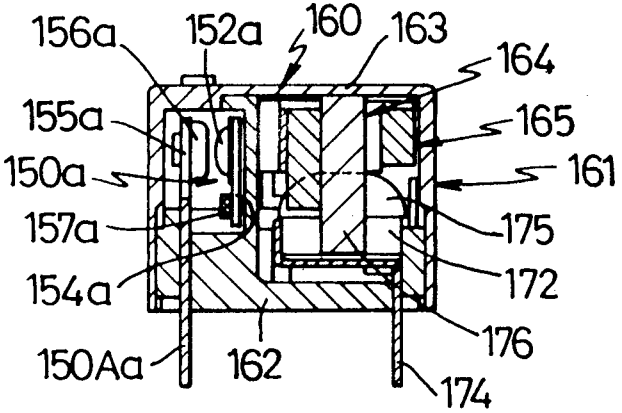
FIG. 24 is a cross-sectional view of the relay of FIG. taken along a line perpendicular to the section of FIG.
Figure 22:
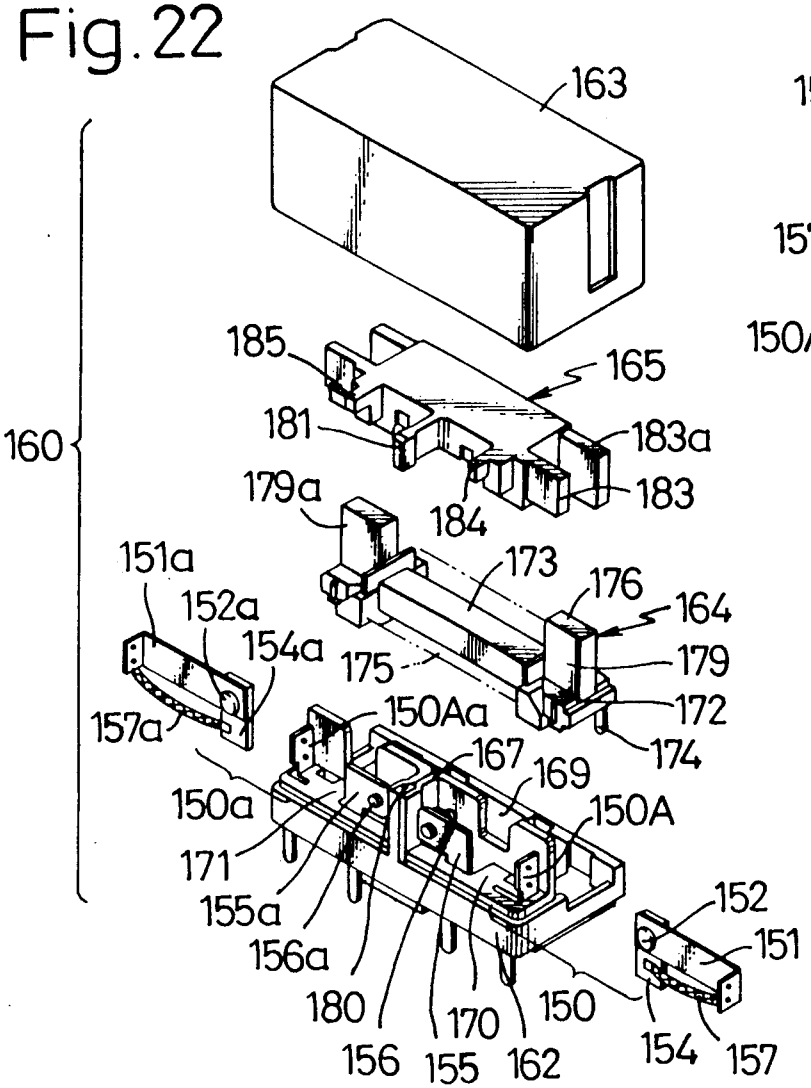
FIG. 22 shows in a perspective view as disassembled another electromagnetic relay employing the contact device in still another embodiment according to the present invention.
Figure 26:
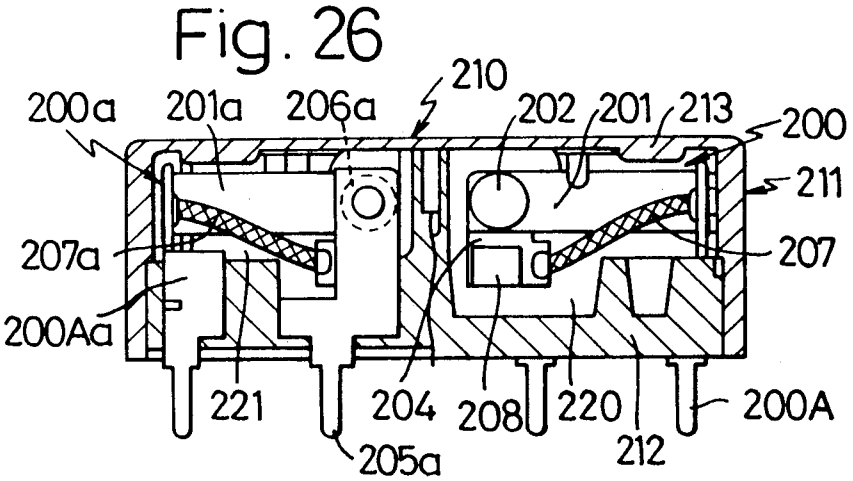
FIG. 26 is a longitudinally sectioned view as assembled of the relay of FIG. 25.
Figure 28:
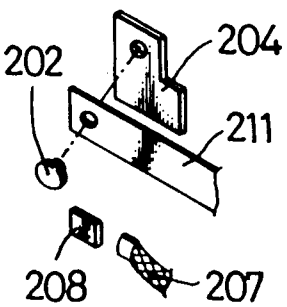
FIG. 28 is a fragmentary perspective view as disassembly of a part of the relay of FIG. 25.
Figure 27:
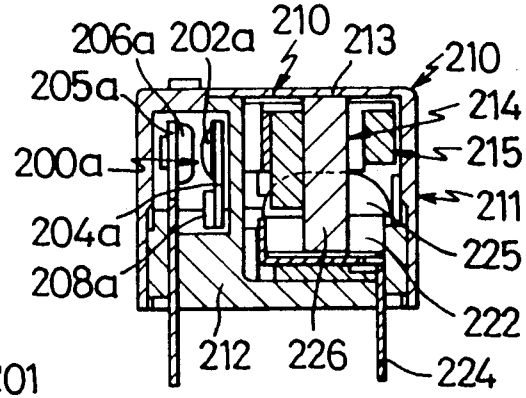
FIG. 27 is a cross-sectioned view of the relay of FIG. 25 taken along a line perpendicular to the section of FIG. 26.
Figure 25:
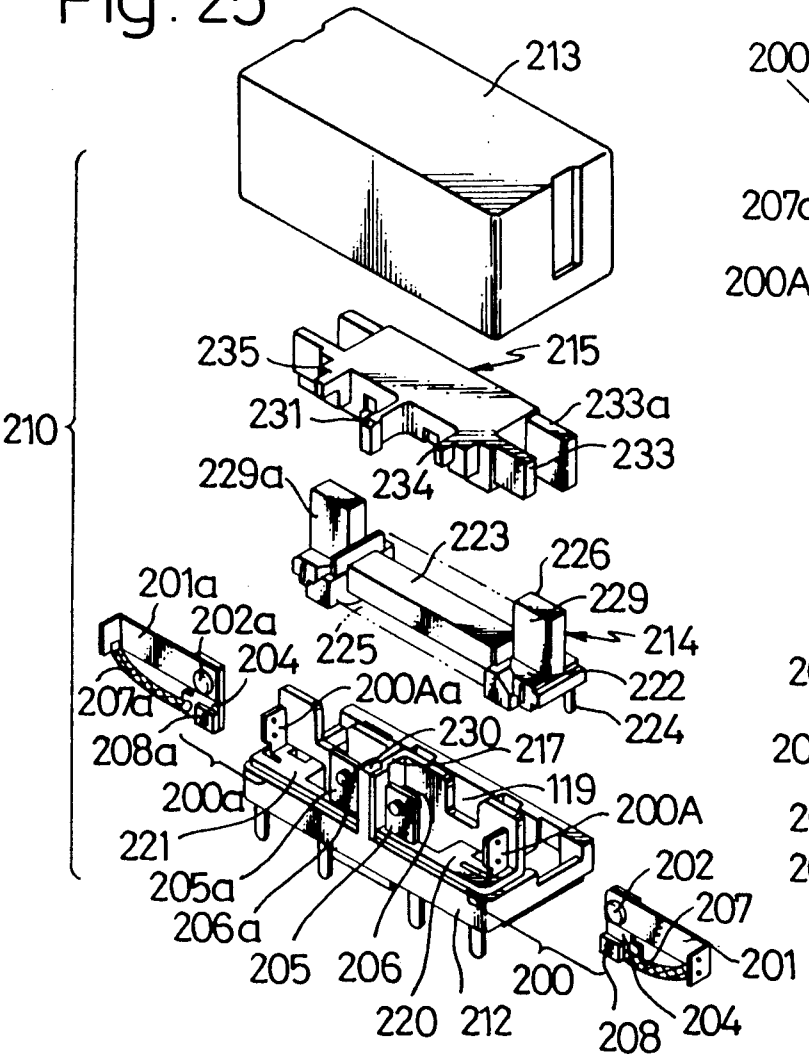
FIG. 25 shows in a perspective view as disassembled still another electromagnetic relay employing the contact device in a still further embodiment according to the present invention.

According to still another feature of the present invention, there is taken a measure for avoiding any influence of the rush current by means of a bypass therefor. Referring to FIGS. 22 to 24, two contact devices 150 and 150*a* respectively comprise movable contact side terminal plates 150A and 150A*a* to which resilient movable contactors 151 and 151*a* carrying at their free ends movable contacts 152 and 152*a* are coupled at the other ends through pins, welding or the like. Additional mass members 154 and 154*a* made of an electrically conducting material are secured to the side opposite to the movable contacts 152 and 152*a* so as to be perpendicular to the longitudinal axis of the movable contactors, and these additional mass members 154 and 154*a* are electrically directly connected through sufficiently soft braided wires 157 and 157*a* to the movable contact side terminal plates 150A and 150A*a*. The movable contacts 152 and 152*a* are disposed to be engageable and disengageable with stationary contacts 156 and 156*a* secured to stationary contact side terminal plates 155 and 155*a* for the contact opening and closing of an electromagnetic relay 160 in which the contact devices 150 and 150*a* are incorporated. Other components of this electromagnetic relay 160 are the same as those in the foregoing embodiment of FIGS. 12–14 and are denoted by the same reference numerals as the ones used in FIGS. 12–14 but added by 80. Further, the arrangement of the present embodiment can be also employed in the embodiment of FIGS. 12–18 in the same manner.

Now, in the present instance, the additional mass members 154 and 154*a* made of the conducting material are provided with a considerable mass, respectively, so that the rolling motion is caused to take place in the movable contactors 151 and 151*a* upon the contact closing operation between the movable and stationary contacts 152 and 156 or 152*a* and 156*a*, and the contacting points between these movable and stationary contacts are thereby shifted positively. When the rush current or short-circuit current is caused to flow through the contact devices, such current is made to pass through the braided wires 157 and 157*a* which are parallel to the movable contactors 151 and 151*a*, so that contact welding between the movable and stationary contacts and a fusing of the contactors 151 and 151*a* can be prevented. According to the present embodiment, therefore, it is possible to remarkably improve the resistance to contact welding and, at the same time, to prevent fusing of the contactors from occurring. Other components and their functions are the same as those in the foregoing embodiments of FIGS. 12–14 and 1–7.

In contact devices 200 and 200*a* in still another embodiment of the present invention as shown in FIGS. 25 to 28, the devices are formed substantially in the same manner as in the above embodiment of FIGS. 22–24, while additional mass members 204 and 204*a* are provided with auxiliary masses 208 and 208*a* made of a magnetic material, and the devices are incorporated into an electromagnetic relay 210. Other components are the same as those in the embodiment of FIGS. 22–24 and are denoted by the same reference numerals as those used in FIGS. 22–24 but added by 50. In the present embodiment, the contacting points between the movable and stationary contacts 202 and 206 as well as 202*a* and 206*a* are positively shifted, while the rush current or short-circuit current is bypassed through the braided wires 207 and 207*a*. Further, the magnetic flux generated by the current flowing through the stationary contact side terminal plate 205 and 205*a* is increased at the auxiliary additional masses 208 and 208*a* to cause the movable contactors 201 and 201*a* attracted to the side of the stationary contact side terminal plates 205 and 205*a* so that the electromagnetic repulsion between the movable and stationary contacts 202 and 206 as well as 202*a* and 206*a* can be prevented, whereby the resistance to contact welding is improved to render the device to be withstandable to any large current. Other components and their functions are the same as those in the foregoing embodiments of FIGS. 22–24, 12–14 and 1–7. In the present instance, the movable contacts 202 and 202*a* material should preferably be secured simultaneously to the resilient movable contactors 201 and 201*a*. Further, the arrangement of the present embodiment can be employed in the foregoing embodiment of FIGS. 8–11 substantially without any modification..

Figure 30:
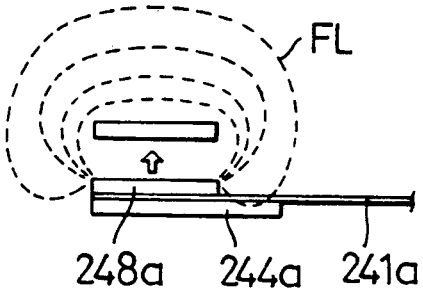
FIG. 30 is a fragmentary plan view as magnified of a contact device just for a comparison with the device of FIG. 29.
Figure 29:
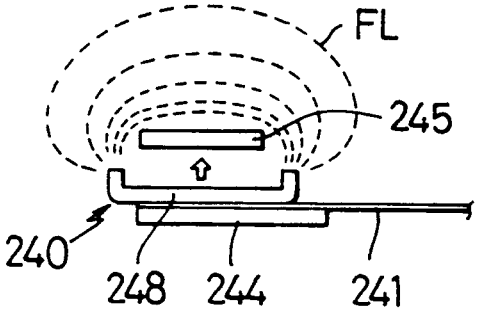
FIG. 29 is a fragmentary plan view as magnified of the contact device in yet another embodiment according to the present invention.

In a contact device 240 in a further embodiment according to the present invention as shown in FIG. 29, an auxiliary additional mass 248 made of a magnetic material and secured to an additional mass member 244 provided integral with a resilient movable contactor 241 is formed to be U-shaped so that both side edges will project towards a stationary contact side terminal plate 245. With this arrangement, the magnetic flux due to the current flowing through the stationary side terminal plate 245 is made higher in the density to cause the movable contactor to be attracted more strongly to the stationary side terminal plate than in the case where the auxiliary additional mass 248*a* of additional mass member 244*a* made integral with the movable contactor 241*a* is flat plate-shaped as shown in FIG. 30. Other components and their functions are the same as those in the foregoing embodiments.

Figure 32:
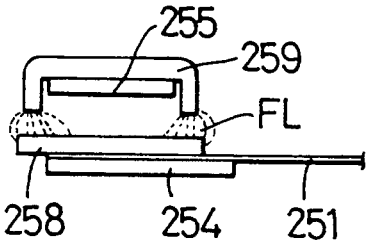

In another contact device 250 shown in FIG. 31 of still another embodiment according to the present invention, an auxiliary additional mass 258 of a flat plate-shaped magnetic material is secured to an additional mass member 254 made integral with a resilient movable contactor 251, while a stationary contact side terminal plate 255 is provided at its portion opposing the auxiliary mass 258 with a magnetic plate member 259 U-shaped in section, both side edges of which shortly projecting towards the auxiliary mass 258. As shown in FIG. 32, the magnetic flux due to the current flowing through the stationary side terminal plate 255 is made to pass through a magnetic path including the auxiliary mass 258 and the U-shaped magnetic plate member 259, so that the movable contactor 251 can be more strongly attracted to the stationary side terminal plate 255. In this case, the magnetic plate member 259 may be secured to the stationary side terminal plate 255 by means of a projection 260 provided on the plate 255, the projection 260 being passed through a hole 261 in the member 259 and secured, as shown in FIG. 33. Further, as in yet another embodiment shown in FIG. 34, a magnetic plate member 279 C-shaped in section may be secured to a stationary contact side terminal plate 275 by having the latter closely embraced by the C-shaped member 279. In these embodiments of FIGS. 31 and 34, other components and their functions are the same as those in the respective embodiments described.

What is claimed is:

1. A contact device comprising:

a stationary contact side terminal plate;

a stationary contact secured to said stationary contact side terminal plate;

a resilient contactor;

a movable contact secured to an end of said resilient contactor which is continuous to said stationary contact upon contact closing;

a movable contact side terminal plate integrally formed at the other end of said resilient contactor; and an additional mass means formed in a separate member and secured to said resilient contactor at a remote location which exerts a force in a direction perpendicular to a longitudinal axis of the resilient contactor and parallel to a direction of movement of said movable contact, so that said movable contact is caused to roll relative to said stationary contact when said movable contact and said stationary contact are contiguous.

2. The device of claim 1 further comprising auxiliary mass means of a magnetic material secured to said resilient contactor and opposite to said stationary contact side terminal plate so that the auxiliary additional mass means is within an electromagnetic influence of the terminal plate.

3. The device of claim 1 wherein said additional mass means is made of an electrically conducting material, and said movable contact side terminal plate includes means for carrying a large current disposed between said additional mass means and said terminal plate comprising a soft conductor.

4. The device of claim 3 wherein said means for carrying current is a braided wire.

5. The device of claim 3 wherein said additional mass means comprises a plate member secured at an end to said resilient contactor, and auxiliary additional mass made of a magnetic material secured to another end of said plate member.

6. The device of claim 5 wherein said stationary contact side terminal plate is provided with a member of magnetic material at a part opposing said auxiliary additional mass on said magnetic material on said resilient contactor providing positive magnetic attraction of said resilient contactor upon contact closing.

7. The device of claim 1 wherein said additional mass means is of an electrically conducting material and is secured to said resilient contactor to be integral therewith together with said movable contact.

8. A remote controlled relay comprising a casing, an electromagnetic means accommodated in said casing, a contact operating means disposed to be pivotally moved by said electromagnetic means, and main and auxiliary contact devices respectively comprising a stationary contact side terminal plate, a stationary contact provided to said stationary contact side terminal plate, a resilient contactor, a movable contact secured to an end of said resilient contactor for contact closing and opening with respect to said stationary contact, a movable contact side terminal plate with which said contactor is made integral at the other end thereof, and an additional mass means secured to said resilient contactor to extend therefrom in a direction perpendicular to a longitudinal axis of the resilient contactor and parallel to the direction of opening and closing of the movable contact, so that said movable contact is caused to roll relative to said stationary contact when said movable contact and said stationary contact are continuous said contact devices being respectively operated by the pivotal movement of said contact operating means for contact closing and opening.

9. The relay of claim 8 wherein said additional mass means is of an electrically conductive material, and said movable contact side terminal plate and additional mass means are mutually connected through a braided wire.

10. The relay of claim 8 wherein a magnetic member is mounted to at least one of said additional mass means and stationary contact side terminal plate.

11. The device of claim 1 wherein said resilient contactor has a suspended part extended in said perpendicular direction at the end having said movable contact and said additional mass means is secured to an extended end of said suspended part.

* * * * *

UNITED STATES PATENT AND TRADEMARK OFFICE

CERTIFICATE OF CORRECTION

PATENT NO. : 5,049,845

DATED : September 17, 1991

INVENTOR(S) : Yokoyama et al.

It is certified that error appears in the above-identified patent and that said Letters Patent is hereby corrected as shown below:

Claim 1, column 11, line 26, change "continuous" to --contiguous--.

Claim 2, column 11, line 42, after "and" insert --disposed--.

Claim 8, column 12, line 37, change "continuous" to --contiguous--.

Signed and Sealed this

Twenty-seventh Day of April, 1993

*Attest:*

*Attesting Officer*

MICHAEL K. KIRK

*Acting Commissioner of Patents and Trademarks*